US009137856B2

(12) United States Patent
Thompson et al.

(10) Patent No.: US 9,137,856 B2
(45) Date of Patent: Sep. 15, 2015

(54) APPARATUS AND METHODS FOR UNFREEZING VEHICLE DOOR WINDOW FROM WINDOW SEAL

(71) Applicants: Eric R Thompson, Clarkston, MI (US); Stephen J Buckley, Novi, MI (US); Jason L Vincent, Howell, MI (US)

(72) Inventors: Eric R Thompson, Clarkston, MI (US); Stephen J Buckley, Novi, MI (US); Jason L Vincent, Howell, MI (US)

(73) Assignee: FCA US LLC, Auburn Hills, MI (US)

( * ) Notice: Subject to any disclaimer, the term of this patent is extended or adjusted under 35 U.S.C. 154(b) by 322 days.

(21) Appl. No.: 13/680,521

(22) Filed: Nov. 19, 2012

(65) Prior Publication Data

US 2014/0138369 A1 May 22, 2014

(51) Int. Cl.
*H05B 1/02* (2006.01)

(52) U.S. Cl.
CPC ..... *H05B 1/0236* (2013.01)

(58) Field of Classification Search
CPC ..... H05B 1/0236
USPC ..... 219/202, 203, 502, 522; 340/438, 584, 340/901; 318/265, 286, 471
See application file for complete search history.

(56) References Cited

U.S. PATENT DOCUMENTS

| | | | | |
|---|---|---|---|---|
| 1,143,402 | A * | 6/1915 | Johnson | 219/203 |
| 4,864,100 | A * | 9/1989 | Cicak | 219/203 |
| 5,121,321 | A | 6/1992 | Sasaki et al. | |
| 6,315,418 | B1 | 11/2001 | Tomare | |
| 6,718,240 | B1 | 4/2004 | Suda et al. | |
| 7,731,373 | B2 | 6/2010 | Oskarsson et al. | |
| 2006/0175877 | A1 * | 8/2006 | Alionte et al. | 297/180.14 |
| 2008/0117079 | A1 * | 5/2008 | Hassan | 340/901 |
| 2008/0202139 | A1 * | 8/2008 | Darroman et al. | 62/244 |
| 2009/0050614 | A1 * | 2/2009 | Renke et al. | 219/203 |
| 2009/0206068 | A1 * | 8/2009 | Ishizeki et al. | 219/203 |
| 2012/0133174 | A1 * | 5/2012 | Syvret et al. | 296/146.2 |

FOREIGN PATENT DOCUMENTS

WO WO 2010133850 A2 * 11/2010 ..... B60J 1/17

* cited by examiner

*Primary Examiner* — Thien S Tran
(74) *Attorney, Agent, or Firm* — Ralph E. Smith

(57) ABSTRACT

An apparatus and method for unfreezing a window from a window seal are disclosed. According to some embodiments of the present disclosure, the apparatus includes a vehicle door assembly including a vehicle door and a window. The apparatus further includes a window seal that receives an upper edge of the window and a heating element coupled to the upper edge or the window seal. The system further includes a power source that provides an electrical current to the heating element and a control module configured to receive a remote unlock signal from a remote device, obtain a temperature signal indicating a temperature in response to the remote unlock signal, compare the temperature indicated by the temperature signal to a temperature threshold, and cause the power source to provide the electrical current to the heating element when the temperature is less than the temperature threshold.

14 Claims, 4 Drawing Sheets

APPARATUS AND METHODS FOR UNFREEZING VEHICLE DOOR WINDOW FROM WINDOW SEAL

FIELD

The present disclosure relates to techniques for preventing freezing and unfreezing and a vehicle door window from a window seal.

BACKGROUND

Some vehicles may be equipped with frameless door assemblies, which include a door and a door window ("window"). In these vehicles, the vehicle frame may include a window seal which receives an upper edge of the window when the door window is in the full up position. When a passenger attempts to enter the vehicle by engaging the door handle, a vehicle controller may command a lift motor to drive the window down a short distance, e.g., one or two centimeters, so that the upper edge of the window is no longer in the window seal. Similarly, when the passenger closes the door, the vehicle controller may command the lift motor to drive the window up a short distance, so that the upper edge of the window is in the seal.

When the temperature in or around the vehicle drops below freezing and there is moisture in the seal or on the upper edge of the window, the window may become frozen to the seal. This may make it more difficult to open the door.

SUMMARY

In accordance with an aspect of the present disclosure, a vehicle includes a vehicle door assembly including a vehicle door and a window movable relative to the vehicle door, the window having an upper edge. The vehicle further includes a window seal that receives the upper edge of the window, a heating element coupled to one of the upper edge of the window and the window seal, and a power source that provides an electrical current to the heating element. The vehicle further includes a control module configured to: receive a remote unlock signal from a remote device, the remote unlock signal instructing the control module to unlock the vehicle door, obtain a temperature signal indicating a temperature in response to receiving the remote unlock signal, compare the temperature indicated by the temperature signal to a temperature threshold, and cause the power source to provide the electrical current to the heating element when the temperature is less than the temperature threshold.

In accordance with an aspect of the present disclosure, a method for unfreezing a door window from a window seal of a vehicle includes receiving a remote signal from a remote device, obtaining a temperature signal indicating a temperature in response to receiving the unlock signal, comparing the temperature indicated by the temperature signal to a temperature threshold, and causing a power source of the vehicle to provide the electrical current to a heating element coupled to one of the upper edge of the window and the window seal when the temperature is less than the temperature threshold.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
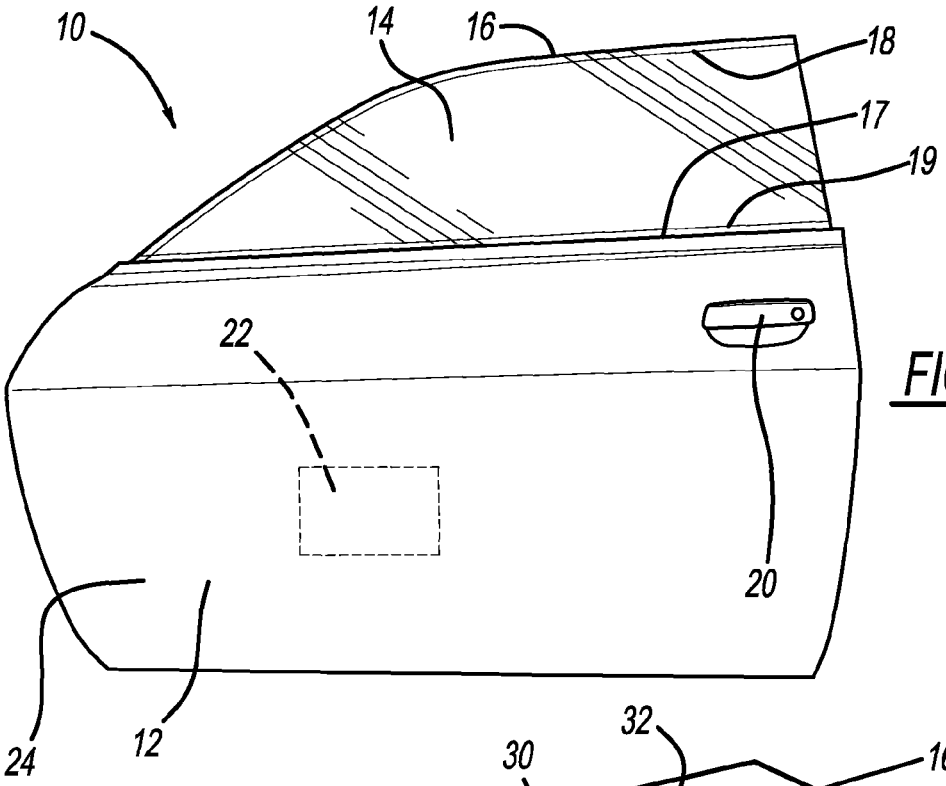
FIG. 1 is a drawing illustrating a vehicle door assembly in accordance with some embodiments of the present disclosure.

Referring now to FIG. 1, a drawing of a vehicle door assembly 10 ("door assembly") is illustrated. In the illustrative embodiment, the door assembly 10 includes a door 12 having a handle 20 and a window 14 movable with respect to the door 12. As should be appreciated, the window 14 is interposed between the front side 24 and the back side (not shown) of the door 12. In the example embodiment, a lift motor 22 moves the window 14 with respect to the door 12.

In the illustrative embodiment, the door assembly 10 is a frameless door assembly. In some embodiments, the lift motor 22 may be controlled to move the window 14 downward a short distance, e.g., one or two centimeters, with respect to the door 12 when the handle 20 is engaged by a passenger. Similarly, when the door 12 is shut by the passenger, the lift motor 22 may be controlled to move the window 14 upward with respect to the door 12. The foregoing configuration may reduce sudden changes in pressure within the vehicle cabin when the door 12 is shut be the passenger.

In the illustrated embodiment, a heating element 18 is coupled to an upper edge 16 of the window 14. While a single heating element 18 is shown, it is noted that the term "heating element" may include more than one heating element. In some embodiments, the heating element 18 can be an electrical wire that heats up when a current flows through the electrical wire. It should be appreciated that other types of heating elements 18 can be used in addition to or in place of the electrical wire.

Figure 2:
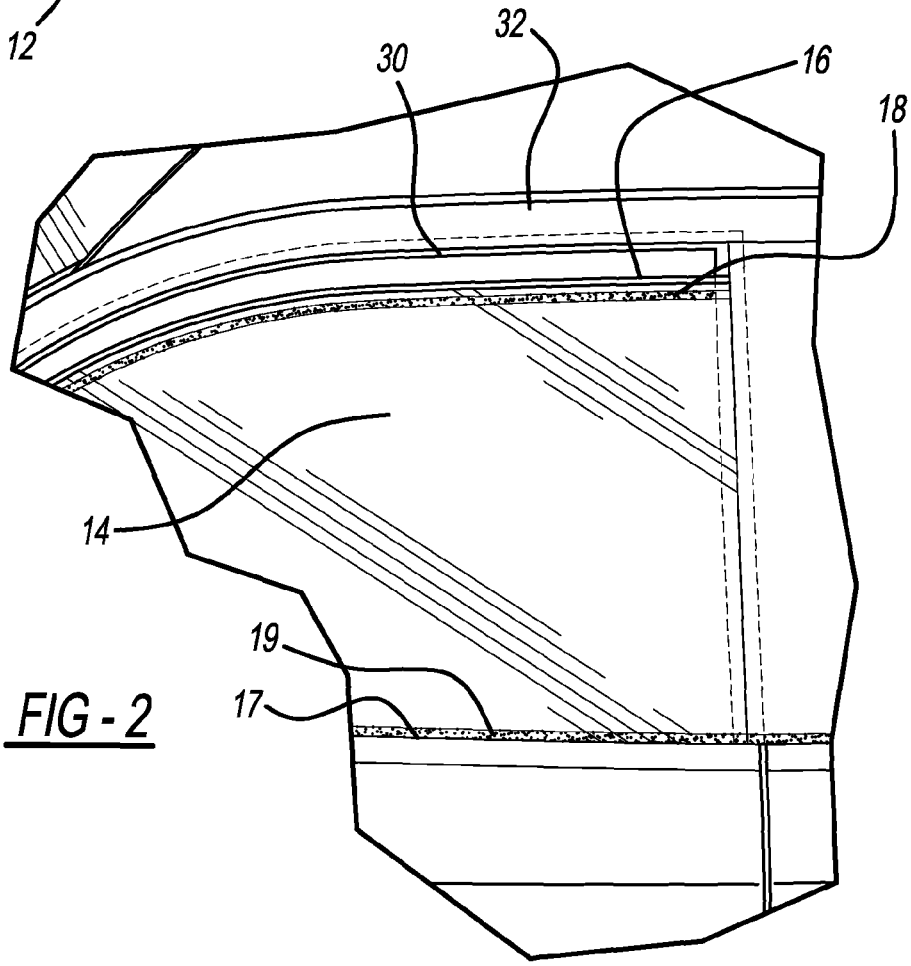
FIG. 2 is a is a drawing illustrating a perspective view of a window seal in accordance with some embodiments of the present disclosure.

Referring now to FIG. 2, a perspective view of a window seal 30 is illustrated. In the illustrated example, the window seal 30 is integrated in the vehicle frame 32. The window seal 30 can be a receptacle that receives the upper edge 16 of the window 14. When the upper edge 16 of the window 14 is received by the window seal 30, a seal is formed between the window 14 and the window seal 30.

If the upper edge 16 of the window 14 is moist or the window seal 30 contains moisture when the window 14 is in a fully up position and the temperatures are below freezing temperatures, the upper edge 16 of the window 14 may freeze to the window seal 30. When the window 14 is frozen to the window seal 30 or if the conditions are appropriate for such an occurrence, e.g., the temperature is below a temperature threshold, the heating element 18 is powered to heat it, which melts any frozen moisture and unfreezes the window 14 from the window seal 30 should it have become frozen to the window seal 30. Further, if window 14 has not frozen to window seal 30, powering heating element 18 to heat it prevents window 14 from freezing to window seal 30. It should be appreciated that in some embodiments the heating element 18 may be coupled to the window seal 30, a door jamb (not shown), or a weather strip (not shown). Furthermore, in some embodiments, additional heating elements 19 may be coupled to a lower edge 17 of the window 14 and/or the window seal 30.

While the foregoing window seal 30 is shown as part of a frameless door assembly configuration, it is appreciated that the foregoing may be applied to a window seal 30 in a framed door assembly.

Figure 3:
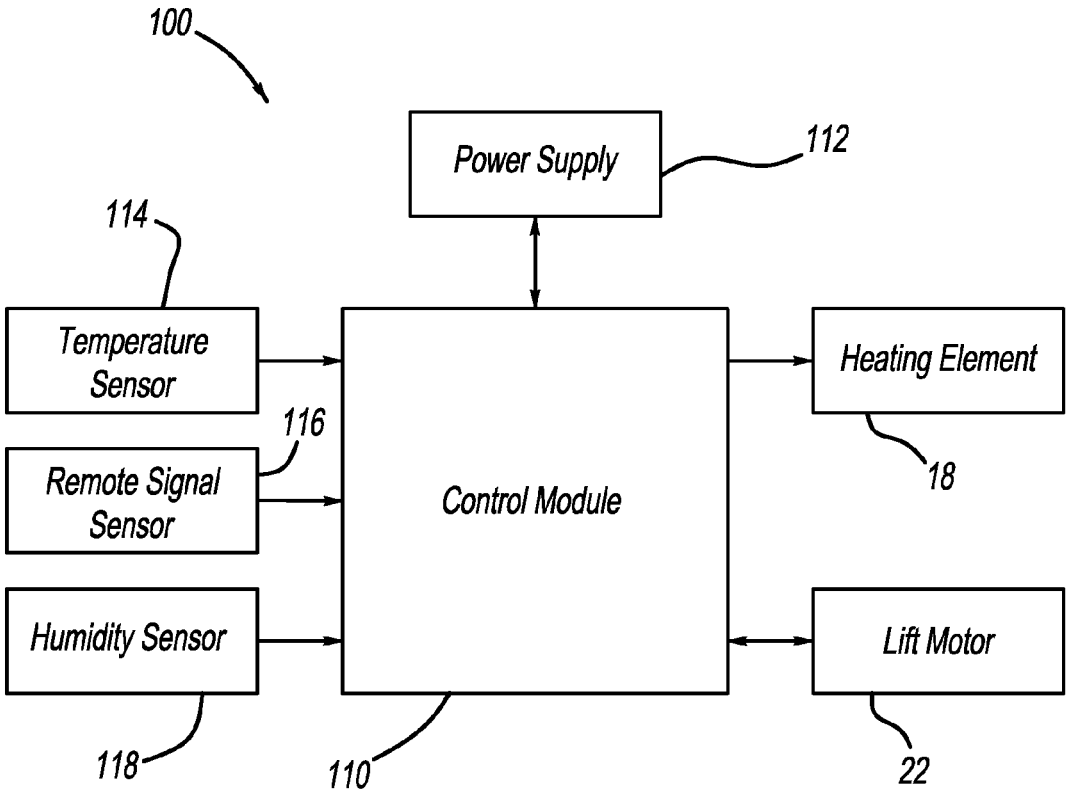
FIG. 3 is a block diagram illustrating exemplary components of a system for unfreezing a window from a window seal in accordance with some embodiments of the present disclosure.

Referring now to FIG. 3, a component block diagram of a system 100 for unfreezing a window 14 from a window seal 30 is illustrated. In the example embodiment, the system 100 includes a control module 110, the lift motor 22, the heating element 18, a power supply 112, a temperature sensor 114, a remote signal sensor 116, and a humidity sensor 118. The exemplary system 10 may be implemented in vehicles having framed door assemblies and frameless door assemblies.

The control module 110 can include a memory storing processor-executable instructions for performing the intended functionality of the control module 110 and one or more processors that execute the processor-executable instructions. The control module 110 may be a vehicle controller unit for the entire vehicle or may be a controller for a subsystem of the vehicle, e.g., the door assembly.

The power supply 112 includes one or more devices that supply an electrical current to one or more components of the system 100. For example, the power supply 112 can include a battery of the vehicle and/or an alternator of the vehicle. The power supply 112 can provide an electrical current to heating element 18, the lift motor 22, the temperature sensor 114, the remote signal sensor 116, and/or the humidity sensor 118.

The temperature sensor 114 is any suitable sensor that outputs a temperature signal indicative of an ambient temperature inside or outside the vehicle. The temperature sensor 114 provides the temperature signal to the control module 110. While one temperature sensor 114 is shown, it should be appreciated that more than one temperature sensor 114 can be distributed throughout the vehicle. In some embodiments, the temperature sensor 114 includes a thermistor that is proximate to the upper edge 16 of the window 14. The humidity sensor 118 is any suitable sensor that outputs a humidity signal indicating one of a relative humidity or an ambient humidity. For example, in some embodiments the humidity sensor 118 is a hygrometer.

The remote signal sensor 116 is any suitable sensor that receives a remote signal from a key fob or any other suitable remote device. As should be appreciated the remote signal sensor 116 may receive remote signals for unlocking the vehicle door 12 (a "remote unlock signal"), locking the vehicle door 12, starting the vehicle (a "remote start signal"), opening a trunk of the vehicle, and/or activating an alarm system of the vehicle. It should be appreciated that the key fob may be active and/or passive. In active configurations, the passenger presses a button on the key fob to generate the remote signal. For example, the passenger may press a button to emit a remote unlock signal. In passive configurations, the key fob emits the remote signal when it is in a close proximity with the vehicle, e.g., less than one meter. For example, when the key fob comes within a close proximity with the vehicle, the key fob emits the remote unlock signal. The remote signal sensor 116 outputs a command signal to the control module 110 corresponding to the type of signal received from the key fob, e.g., a remote unlock signal or a remote start signal.

The lift motor 22 receives signals from the control module 110 indicating a direction to move the window 14, i.e., upward or downward. In some embodiments, the lift motor 22 is configured to output one or more diagnostic signals indicating a condition or status of the lift motor 22, including a "mechanical stuck signal." A mechanical stuck signal indicates that the lift motor 22 is attempting to move the window 14 but is unable to move the window 14 because the window 14 is stuck. For example, if the gears of the lift motor 22 are unable to rotate, the lift motor 22 outputs the mechanical stuck signal. As should be appreciated, if the window 14 is frozen to the window seal 30 and the lift motor 22 receives a signal to move the window 14 downward, the lift motor 22 can output the mechanical stuck signal.

In the illustrative embodiment, the control module 110 monitors one or more of the temperature sensor 114, the remote signal sensor 116, the lift motor 22, and/or the humidity sensor 118 to determine whether conditions are such that the window 14 may become or is frozen to window seal 30. If the control module 110 determines that the window 14 may become or is frozen to the window seal 30, the control module 110 causes the power supply 112 to provide an electrical current to the heating element 18 to unfreeze the window 14 from the window seal 30, which also prevents it from freezing to window seal 30 if wasn't frozen to window seal 30.

In some embodiments, the control module 110 monitors the temperature sensor 114 and the remote signal sensor 116 to determine whether the window 14 may become or is frozen to the window seal 30. In these embodiments, the control module 110 obtains the temperature signal from the temperature sensor upon the remote signal sensor 116 receiving a remote unlock signal and/or a remote start signal from the key fob. The control module 110 then compares the temperature to a temperature threshold to determine whether the window 14 may become or is frozen to the window seal 30. In some embodiments, the temperature threshold may be approximately 32 degrees F. It should be appreciated that the temperature threshold may be set to a lower value, e.g., 10 degrees F. If the temperature is below the temperature threshold, the control module 110 causes the power supply 112 to provide the electrical current to the heating element 18. For example, the control module 110 may close a switch between the power supply 112 and the heating element 18. The power supply 112 may energize the heating element 18 for a predetermined amount of time, e.g., one or two minutes, such that any ice that may have been built up in the window seal 30 is melted. Alternatively, the power supply 112 may energize the heating element 18 until a temperature near the upper edge 16 of the window 14 reaches a predetermined temperature.

In some embodiments, the control module 110 monitors the lift motor 22, the remote signal sensor 116, and the temperature sensor 114 to determine whether the window 14 is frozen to the window seal 30. In these embodiments, the control module 110 can receive a command signal indicating that a remote unlock signal and/or a remote start signal was received by the remote signal sensor 116. Furthermore, the control module 110 can also receive a signal from the handle 20 indicating that the door handle 20 has been engaged. In response to the signal from the handle 20, the control module 110 can command the lift motor 22 to move the window 14 down a relatively short distance, e.g., 1 or 2 cm. If the lift motor 22 is unable to move the window 14 down, the lift motor 22 outputs a mechanical stuck signal to the control module 110. In response to the mechanical stuck signal, the control module 110 obtains the temperature from the temperature sensor 114 and compares the temperature to the temperature threshold. If the temperature is less than the temperature, the control module 110 determines that the window 14 is frozen to the window seal 30 and causes the power supply 112 to provide an electrical current to the heating element 18. The power supply 112 may energize the heating element 18 for a predetermined amount of time, e.g., one or two minutes, such that any ice that may have been built up in the window seal 30 is melted. Alternatively, the power supply 112 may energize the heating element 18 until the lift motor 22 is able to move the window 14.

In some embodiments, the control module 110 monitors the remote signal sensor 116, the temperature sensor 114, and the humidity sensor 118 to determine whether the window 14 may become or is frozen to the window seal 30. In these embodiments, the control module 110 obtains the temperature from the temperature sensor 114 and the ambient or relative humidity from the humidity sensor 118 upon the remote signal sensor 116 receiving the remote unlock and/or the remote start signal from the key fob. The control module 110 compares the temperature to the temperature threshold and the humidity to a humidity threshold. If the temperature is below the temperature threshold and the humidity is above a humidity threshold, the control module 110 determines that the window 14 may become or is frozen to the window seal 30 and causes the power supply 112 to provide an electrical current to the heating element 18. The power supply 112 may energize the heating element 18 for a predetermined amount of time, e.g., one or two minutes, such that any ice that may have been built up in the window seal 30 is melted. Alternatively, the power supply 112 may energize the heating element 18 until a temperature near the upper edge 16 of the window 14 reaches a predetermined temperature.

It should be appreciated that the foregoing techniques are provided for example, and variations of the techniques are within the scope of the disclosure. Furthermore, not all of the components of the system 100 described with respect to FIG. 3 are required and the system 100 may include additional components. Moreover, while the techniques described above are described with respect to vehicles having power window systems, it should be appreciated that some embodiments may be applicable to manual window systems as well.

Figure 4:
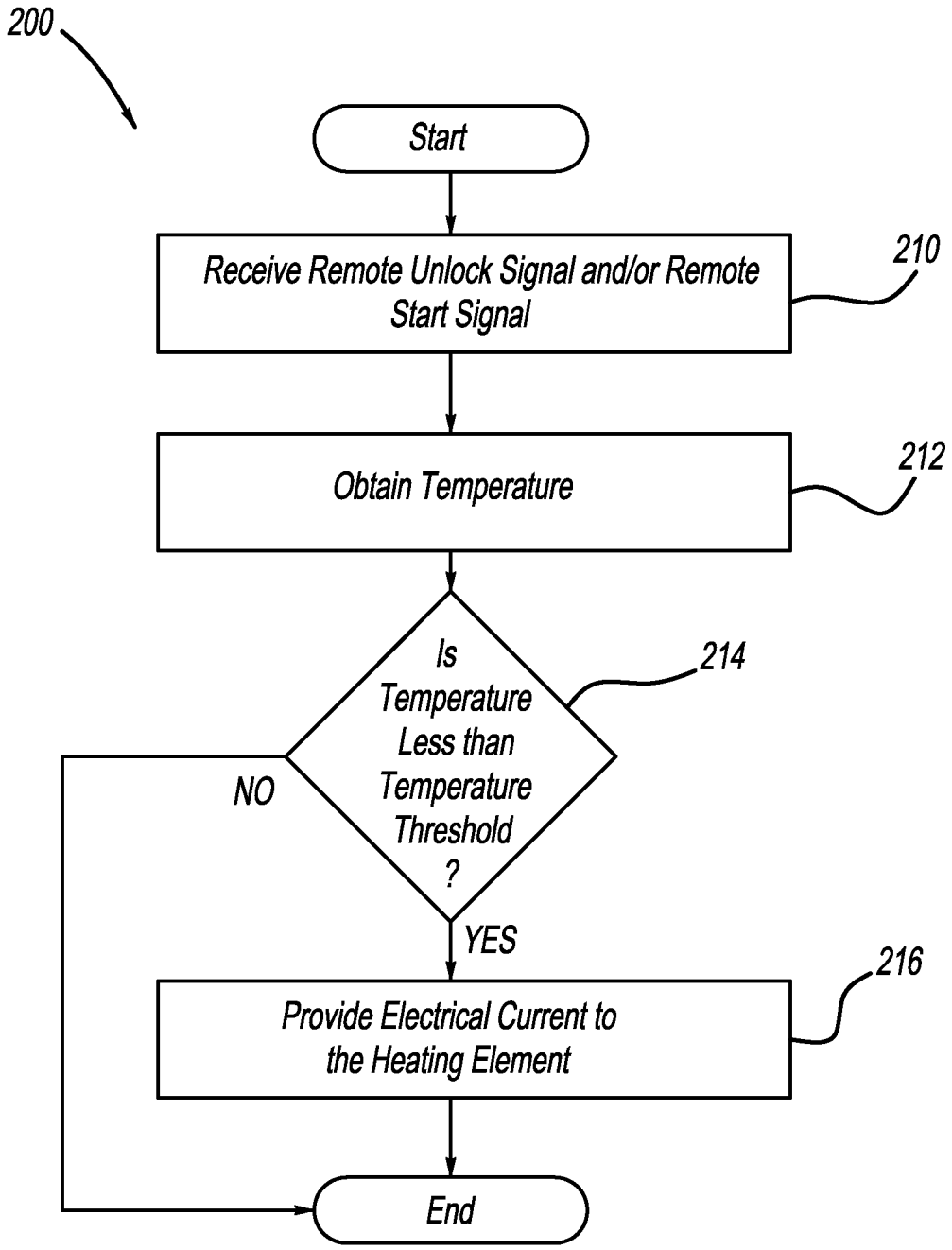
FIG. 4 is a flow chart illustrating an exemplary method for determining whether to provide an electrical current to a heating element in accordance with some embodiments of the present disclosure.

Referring now to FIG. 4, a flow chart illustrating a method 200 for determining whether to provide an electrical current to the heating element 18 is illustrated. The method 200 may be performed by the control module 110.

The method 200 may begin executing when a remote unlock signal or remote start signal is received, as shown at operation 310. Upon receiving the remote signal and/or the remote start signal, the control module 110 obtains an ambient temperature at or around the vehicle, as shown at operation 312. As previously discussed, the control module 110 can obtain the ambient temperature from a temperature signal output by the temperature sensor 114. At operation 314, the control module 110 compares the temperature to a temperature threshold. If the temperature is greater than the temperature threshold, the method stops executing. If the temperature is less than the temperature threshold, the control module 110 causes the power supply 112 to provide an electrical current to the heating element 18, as shown at operation 216. The electrical current can be provided to the heating element for a predetermined amount of time or until a determination can be made as to whether the window 14 remains frozen to the window seal 30.

The foregoing method 200 is provided for example and is not intended to be limiting. The method 200 may include additional operations and some operations may be combined into a single operation. Variations of the method 200 are within the scope of the disclosure.

Figure 5:
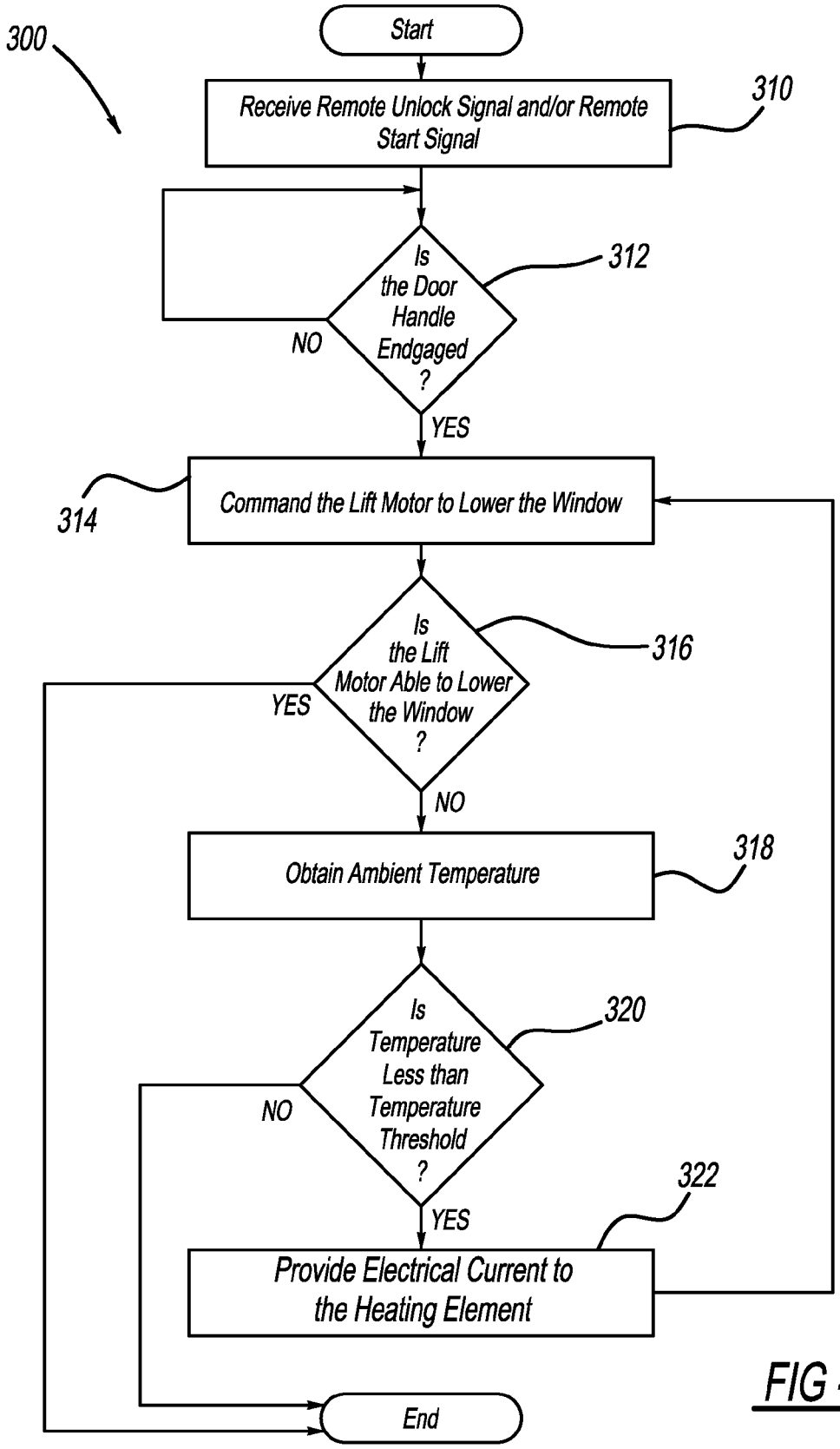
FIG. 5 is a flow chart illustrating an exemplary method for determining whether to provide an electrical current to a heating element in accordance with some embodiments of the present disclosure.

Referring now to FIG. 5, a flow chart illustrating a method 300 for determining whether to provide an electrical current to the heating element 18 is illustrated. The method 300 may be executed by the control module 110.

The method can begin executing when a remote unlock signal or remote start signal is received, as shown at operation 310. Upon receiving the remote signal and/or the remote start signal, the control module 110 waits for the door handle 20 to be engaged, as shown at operation 312. Once the door handle 20 is engaged, the control module 110 commands the lift motor 22 to move the window 14 downward relative to the door 12, as shown at operation 314. The control module 110 further determines whether the lift motor 22 was able to move the window 14, as shown at operation 316. As previously described, the control module 110 monitors the lift motor 22 for a mechanical stuck signal. If the lift motor 22 is able to move the window 14, the method 300 stops executing.

If the lift motor 22 is unable to move the window 14, the control module 110 obtains an ambient temperature at or around the vehicle, as shown at operation 318. At operation 320, the control module 110 compares the ambient temperature to a temperature threshold. If the temperature is greater than the temperature threshold, the method stops executing. If the temperature is less than the temperature threshold, the control module 110 causes the power supply 112 to provide an electrical current to the heating element 18, as shown at operation 322. As the electrical current is being provided to the heating element 18 or after a predetermined amount of time, the control module 110 commands the lift motor 22 to lower the window 14. It should be appreciated that the control module 110 can continue in this manner until the lift motor 22 is able to lower the window 14.

The foregoing method 300 is provided for example and is not intended to be limiting. The method 300 may include additional operations and some operations may be combined into a single operation. Variations of the method 300 are within the scope of the disclosure.

As used herein, the term module may refer to, be part of, or include: an Application Specific Integrated Circuit (ASIC); an electronic circuit; a combinational logic circuit; a field programmable gate array (FPGA); or a processor; other suitable components that provide the described functionality; or a combination of some or all of the above, such as in a system-on-chip. The term module may also include memory (shared, dedicated, or grouped) that stores code executed by the one or more processors.

The term code, as used above, may include software, firmware, byte-code and/or microcode, and may refer to programs, routines, functions, classes, and/or objects.

The techniques described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are non-volatile memory, magnetic storage, and optical storage.

What is claimed is:

1. A vehicle, comprising:

a vehicle door assembly including a vehicle door and a window movable relative to the vehicle door, the window having an upper edge;

a window seal that receives the upper edge of the window;

a heating element coupled to one of the upper edge of the window and the window seal;

a power source that provides an electrical current to the heating element; and a control module configured to:

receive a remote unlock signal from a remote device, the remote unlock signal instructing the control module to unlock the vehicle door;

obtain a temperature signal from a temperature sensor indicating a temperature in response to receiving the remote unlock signal;

compare the temperature indicated by the temperature signal to a temperature threshold; and cause the power source to provide the electrical current to the heating element when the temperature is less than the temperature threshold, wherein the vehicle door assembly further includes a lift motor that moves the window, the lift motor outputting a mechanical stuck signal to the control module when the lift motor is unable to move the window, and wherein the control module causes the power source to provide the electrical current to the heating element when the temperature is less than the temperature threshold and the mechanical stuck signal is received.

2. The vehicle of claim 1, wherein the control module is further configured to receive a remote start signal from the remote device, wherein the control module obtains the temperature signal in response to receiving the remote start signal and the remote unlock signal.

3. The vehicle of claim 1, further comprising a humidity sensor that outputs a humidity signal indicating a humidity value, and wherein the control module is further configured to:

obtain the humidity signal; and compare the humidity value to a humidity threshold, wherein the control module causes the power source to provide the electrical current to the heating element when the temperature is less than the temperature threshold and the humidity value is greater than the humidity threshold.

4. The vehicle of claim 1, wherein the temperature is an ambient temperature.

5. The vehicle of claim 1, wherein the vehicle door assembly is a frameless door assembly and further includes:

a handle that outputs a handle signal in response to being engaged; and wherein the lift motor moves the window down with respect to the door in response to the handle signal.

6. The vehicle of claim 1, wherein the unlock signal is received from one of a passive key fob and an active key fob.

7. A method for unfreezing a window from a window seal of a vehicle, the window being part of a vehicle door assembly and having an upper edge that is received by the window seal, the vehicle door assembly including a vehicle door, the method comprising:

receiving a remote signal from a remote device;

obtaining a temperature signal indicating a temperature in response to receiving the unlock signal;

comparing the temperature indicated by the temperature signal to a temperature threshold; and causing a power source of the vehicle to provide the electrical current to a heating element when the temperature is less than the temperature threshold, wherein the vehicle door assembly further includes a lift motor that moves the window and outputs a mechanical stuck signal when the lift motor is unable to move the window, and the method further comprises:

receiving the mechanical stuck signal, wherein the electrical current is provided to the heating element when the temperature is less than the temperature threshold and the mechanical stuck signal is received.

8. The method of claim 7, wherein the remote signal is a remote unlock signal indicating a command to unlock the door of the vehicle assembly.

9. The method of claim 7, wherein the remote signal is a remote start signal indicating a command to start an engine of the vehicle.

10. The method of claim 7 wherein the remote signal includes a remote unlock signal indicating a first command to unlock the door of the vehicle assembly and a remote start signal indicating a second command to start an engine of the vehicle, wherein the temperature signal is received in response to receiving the remote start signal and the remote unlock signal.

11. The method of claim 7, further comprising:

obtaining a humidity signal indicating a humidity value in response to receiving the remote signal;

comparing the humidity value to a humidity threshold;

wherein the electrical current is provided to the heating element when the temperature is less than the temperature threshold and the humidity value is greater than the humidity threshold.

12. The method of claim 7, wherein the temperature signal is obtained from a temperature sensor that outputs the temperature signal indicative of the temperature.

13. The method of claim 12, wherein the temperature is an ambient temperature.

14. The method of claim 7, wherein the vehicle door assembly is a frameless door assembly and the method further comprises:

receiving a handle signal in response to a handle of the door being engaged; and commanding the lift motor to move the window down with respect to the door in response to the handle signal.

* * * * *